US006435118B1

(12) United States Patent
Pawley, Jr.

(10) Patent No.: US 6,435,118 B1
(45) Date of Patent: Aug. 20, 2002

(54) PAWLEY SAILBOAT AND RIGGING DESIGN

(76) Inventor: William Douglas Pawley, Jr., 9830 SW. 158 St., Miami, FL (US) 33157

( * ) Notice: Subject to any disclaimer, the term of this patent is extended or adjusted under 35 U.S.C. 154(b) by 0 days.

(21) Appl. No.: 09/356,016

(22) Filed: Jul. 19, 1999

Related U.S. Application Data

(60) Provisional application No. 60/094,456, filed on Jul. 29, 1998.

(51) Int. Cl.[7] ..... B63B 35/00; B63B 35/79

(52) U.S. Cl. ..... 114/39.13; 114/39.32

(58) Field of Search ..... 114/89, 90, 97, 114/39.12, 39.13, 39.32, 39.25, 102.29, 102.1

(56) References Cited

U.S. PATENT DOCUMENTS

| | | | | | |
|---|---|---|---|---|---|
| 2,444,526 | A | * | 7/1948 | Pawley | 114/39 |
| 4,664,049 | A | * | 5/1987 | Mourgue et al. | 114/39 |
| 4,803,939 | A | * | 2/1989 | Jones | 114/39.1 |
| 5,575,229 | A | * | 11/1996 | Blackmer | 114/39.2 |

* cited by examiner

*Primary Examiner*—S. Joseph Morano
*Assistant Examiner*—Patrick Muldoon

(57) ABSTRACT

A sailboat with a planning hull and a mast stepped aft of amidship. The mail sail and foresails are loose footed and attached to a midstay and forestay respectively. The mast is angled towards the rear of the boat and the resultant configuration eliminates the downward force conventional sail configuration imparts on the sailboat. The sailboat has a keel however does not use ballast.

4 Claims, 3 Drawing Sheets

PAWLEY SAILBOAT AND RIGGING DESIGN

CROSS-REFERENCE TO RELATED APPLICATIONS

I submitted a Provisional application Ser. No. 60/094,456 dated Jul. 29, 1998.

My original U.S. Pat. No. 2,444,526 was granted on Jul. 6, 1948. The test boat built in about 1948 was sailed only three times before it was wrecked against a seawall in a thunder storm. I know of no other boat ever having been built, because it wasn't very practical the way that the sails and rigging were built.

I am now applying for a New Patent based upon an improvement in the design of the Sails and Rigging. These improvements were learned from the test boat that was lost. This patent application is not for the boat, but rather for the design of the Sails and Rigging.

BACKGROUND OF THE INVENTION

My Patent was U.S. Pat. No. 2,444,526 dated Jul. 6, 1948 on the design of a Sail Boat; but as far as I know, except for the test boat, it has not been used by me or anyone else. Probably because the Sail and Rigging Design was not practical without the improvements that I am now including in this new Patent Application based upon an "Improvement".

This design was originally conceived while sailing a sixteen foot Snipe Sail Boat in a twenty-five mile wind. Before we hoisted the sails at the dock, the stern was almost under water with the weight of four of us in the stern. After setting sail we were sailing with a wind of twenty-five miles per hour abeam (90 degrees off of our side). We were sailing North and South, the wind was from the East. The four of us were now sitting, as it were, on the high end of a see-saw. The bow was now almost under water, even though the bow was the widest, deepest, and most buoyant part of the hull. The sail was creating a downward force in the bow that I estimated to be equal to the weight of eight people, or about 1400 lbs. Down in the bow. (See Drawing—I).

I was an Air force Pilot with a talent for aircraft design, and I was amazed as I watched the bow being driven down by the sail forces. Then I understood why the Conventional Sail Design can not be used on a fast Planing Speed Boat Hull. The Speed Boat Planing Hull must carry the weight in the stern.

Suddenly I understood what sailors mean when they say a sailboat is lugging canvas! I understood how a mast could be driven through the keel in heavy weather, and how one could gain speed by shortening sail, and letting the hull rise out of the water.

My analytical mind was racing to find a reason for this terrible downward pressure in the bow. We were dragging a large wave behind us and the windward stay sounded like a Base Fiddle string. I had heard that the forces from the sail are transmitted by the mast to the hull, and I could see it happening.

The force being created by the sail, if properly directed, I estimated would drive my sixteen foot Chris-Craft at a speed of about thirty miles per hour, but not with the downward force in the bow. As it was, we were doing about ten miles per hour.

The force diagram on Drawing No. I shows where the forces are on the conventional sail and where they are mounted on the hull. (I am told that the forces created by the sail increase as the square of the wind velocity increase).

When I discovered where the downward force was coming from that prevented the use of the sail on a speedboat hull; the next task was to redesign the Sails and the Rigging and attempt to eliminate the downward force, so that the sail could be used on a fast speedboat planing hull. The results of some experiments was exciting! The downward force had been eliminated and an upward force in the bow had been created! You will see in Drawing No. 2 the new Force Diagram, which allows the Sail and Rigging to be used on any fast planing hull.

This design will improve the performance of any Sail Boat, Catamaran, Scow, or Hydro Foil Boat, but mounted on a properly designed speedboat hull its speed is unlimited; it depends on the speed of the wind and the ability of the crew to hold it down.

This is the first major change in Sailboat Sail and Rigging Design in about one hundred years, since the Marcony Rig Design. This is the fastest Sail Boat Design in existence. Tests indicate that the Sail and Rigging Design on the proper hull should attain a speed of approximately fifty miles per hour in a thirty mile wind, and faster in higher wind conditions. Ice boats will do ninety miles per hour in about thirty miles of wind, but of course, they have little drag.

More details of the design will be explained in the section of this application entitled "Detailed Description of the Design".

BRIEF SUMMARY OF THE INVENTION

Conventional Sail Boats are slow; they draw a lot of water because of their deep keels; they are narrow and lack space inside because of the hull design. They have narrow displacement hulls in an effort to increase their slow speeds; then they have to have deep heavy keels for stability, which also increase the drag underwater.

They spend millions of dollars on Americas Cup Boats in Wind Tunnels and Water Tanks trying to get more speed; but sadly, their Basic Design is flawed. It has been done that way for a hundred years, and so they keep on doing it.

Drawing No. 1 shows the displacement Hull that is deep up forward where the mast is stepped. The hull has to be deep and wide up forward to support the downward force created by the Sails, and transmitted to the hull through the mast. You could put ten thousand horsepower in that boat and you would gain very little speed, because water is heavy and it will not move fast.

You must get out of the water and plane on top of the water like a stone in order to be fast. When the stone is skipping over the water, it is fast, but when is digs into the water, it stops at once!

The whole concept of the Pawley Sail and Rigging Design is to eliminate the downward forces created by the Conventional Sail and Rigging design so that the Sails can be used on a fast planing hull. Drawing No. 2 shows clearly the forces created by the Pawley Design which make it ideal for fast planing hulls.

The Foresail looks like a Spinnaker but it is not! There is a vast difference in SAIL design; in SAIL mounting; and in SAIL performance!

The Pawley sails are made to lie flat on the floor (a conventional sail will not because it has a belly sewed into it). The Pawley sail is made to act like an aeroplane wing creating one directional force. See Drawing No. 2. The sails can be made of any Sail material cloth; Dacron, Plastic or even light metal like an aeroplane wing.

For years they have made conventional masts streamlined to reduce the disturbance of the windflow over the mainsail.

The Mainsail of the Pawley Design is mounted on the Forestay (a cable) it has no disturbance of the windflow over the Mainsail. The smaller of the two sails is mounted aft on a Midstay (a cable) under an "A-frame" or a "U frame" mast. This eliminates all disturbance of the windflow over the Aft Sail also. See Drawing No. 3.

You will notice in Drawing No. 2 that whatever Mast is used it is mounted Amid-ship or aft of Amid-ship and it is raked Aft so that the Mast-Head is almost over the stern of the boat. This increases the length of the Forestay thereby increasing the length of the airfoil section of the Foresail; it also raises the angle of lift created by the Sail, from horizontal.

You will also notice that Wishbone Booms are used instead of the conventional wooden or metal booms. See Drawing No. 2. This is absolutely necessary in order to maintain the airfoil shape of the sail so that it will produce one directional force instead of two. Anything that will help to keep the airfoil shape in the sail should be used, such as stiff Plastic Sail material or battens or maybe a constructed airfoil section.

You will notice in Drawing No. 2 that the hull is a fast planing hull. The hull is wide and the keels are thin metal or fiberglass sheets with no weight, and practically no drag.

This is a brief summary of the Invention. I will cover more detail later on in the

This drawing shows the two forces created by the Mainsail and two forces created by the Jib. These are two forces created by the Mainsail because of the design of the Sail and the Rigging which results in two airfoil sections, each creating a different directional force; one forward, and the other down. One airfoil section is behind the mast; and the other is above the boom (each is indicated in Drawings No. 1 and 2 by a zig-zag line along its axis). When the sail is stitched together a belly is made in the sail to accommodate the two airfoil sections. That is why the conventional sail will not lie flat on the floor. It has two airfoil sections made into it.

For the purpose of comparison I have indicated a force of fifty lbs. Forward on the mast in a ten mile wind; and twenty-five lbs downward on the boom, because it is about one-half as long as the mast.

These forces are transmitted to the hull at the point where the mast is stepped, and so I have drawn a force diagram at that point showing a resultant force of about sixty five lbs down and forward. (This force increases as the square of the wind increase).

The forces on the Jib are indicated by directional arrows.

This hull is similar to the conventional sailboat hull. It is a displacement hull, and for that reason it will never be fast, because it makes the water flow around it; and water does not move fast. They make the hulls more narrow to try to make them faster, then they have to use large heavy keels to keep the boats from turning over. This adds to the drag underwater.

This sail and rigging design creates a downward force in the bow, and for that reason it cannot be used on a fast speedboat Planing hull, because the Planing hull must carry its weight in the stern.

Figure 1:
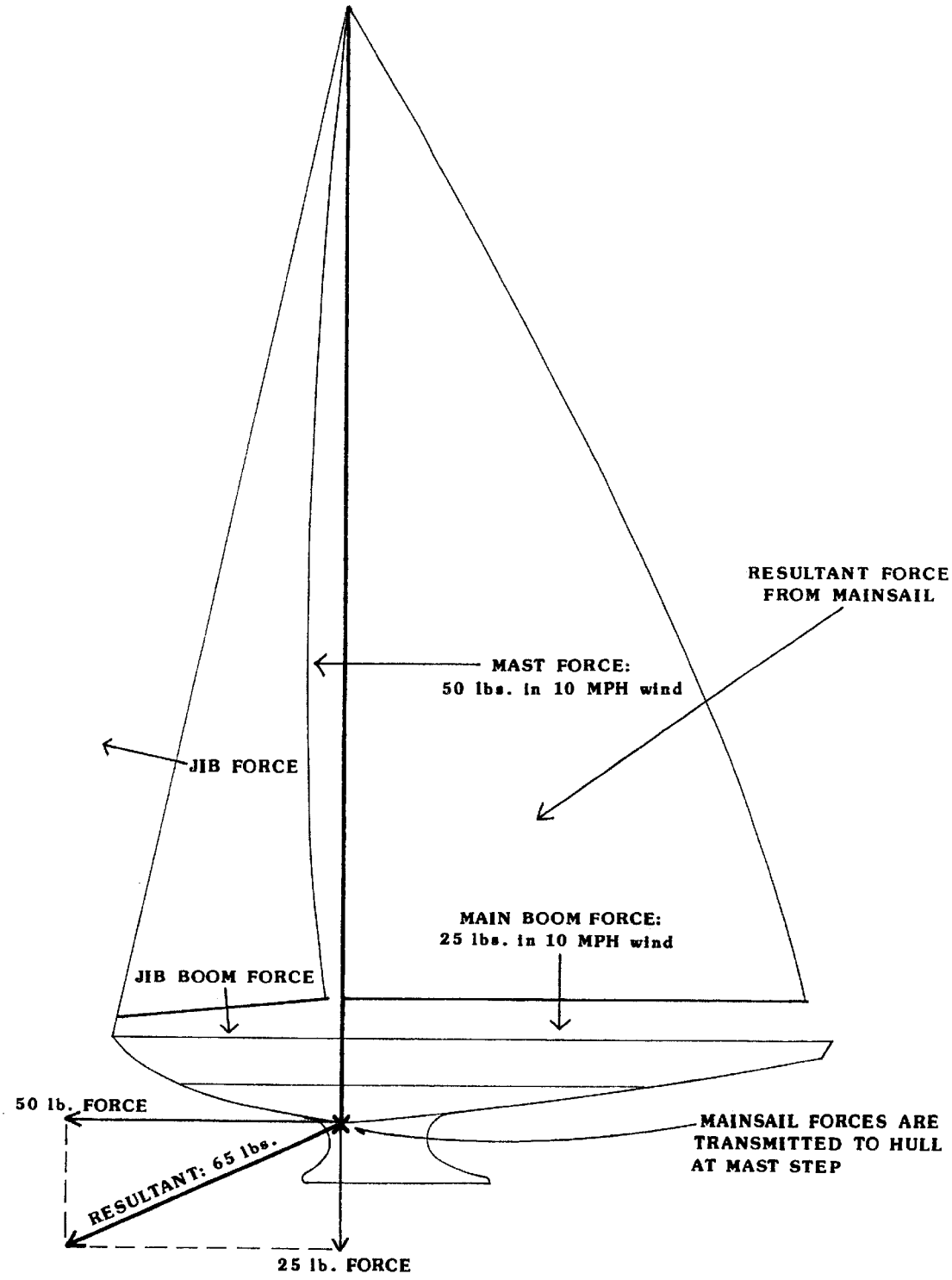
FIG. 1—CONVENTIONAL SAIL FORCE DIAGRAM
Figure 2:
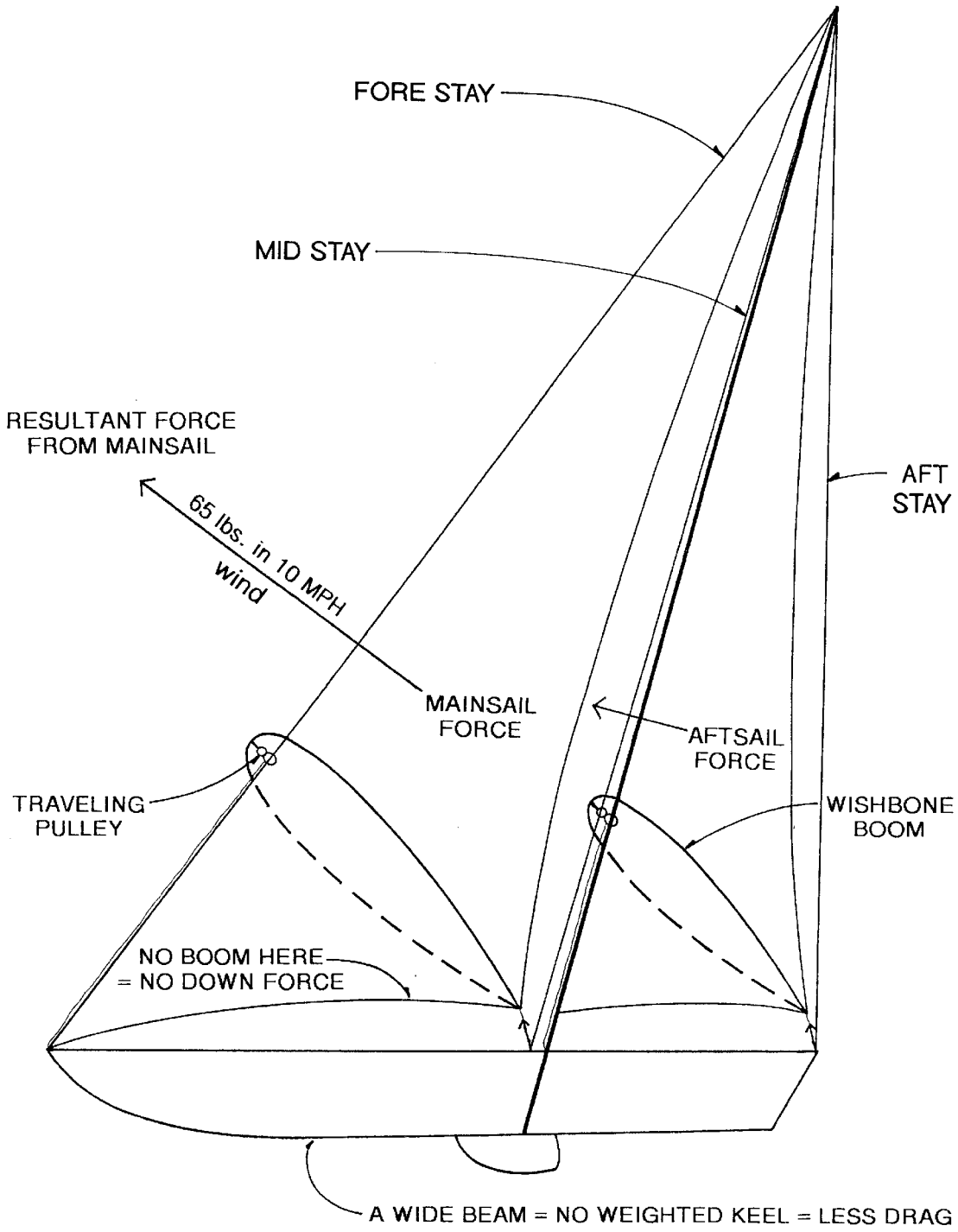

FIG. 2 is a side view of the sailboat.

Figure 3:
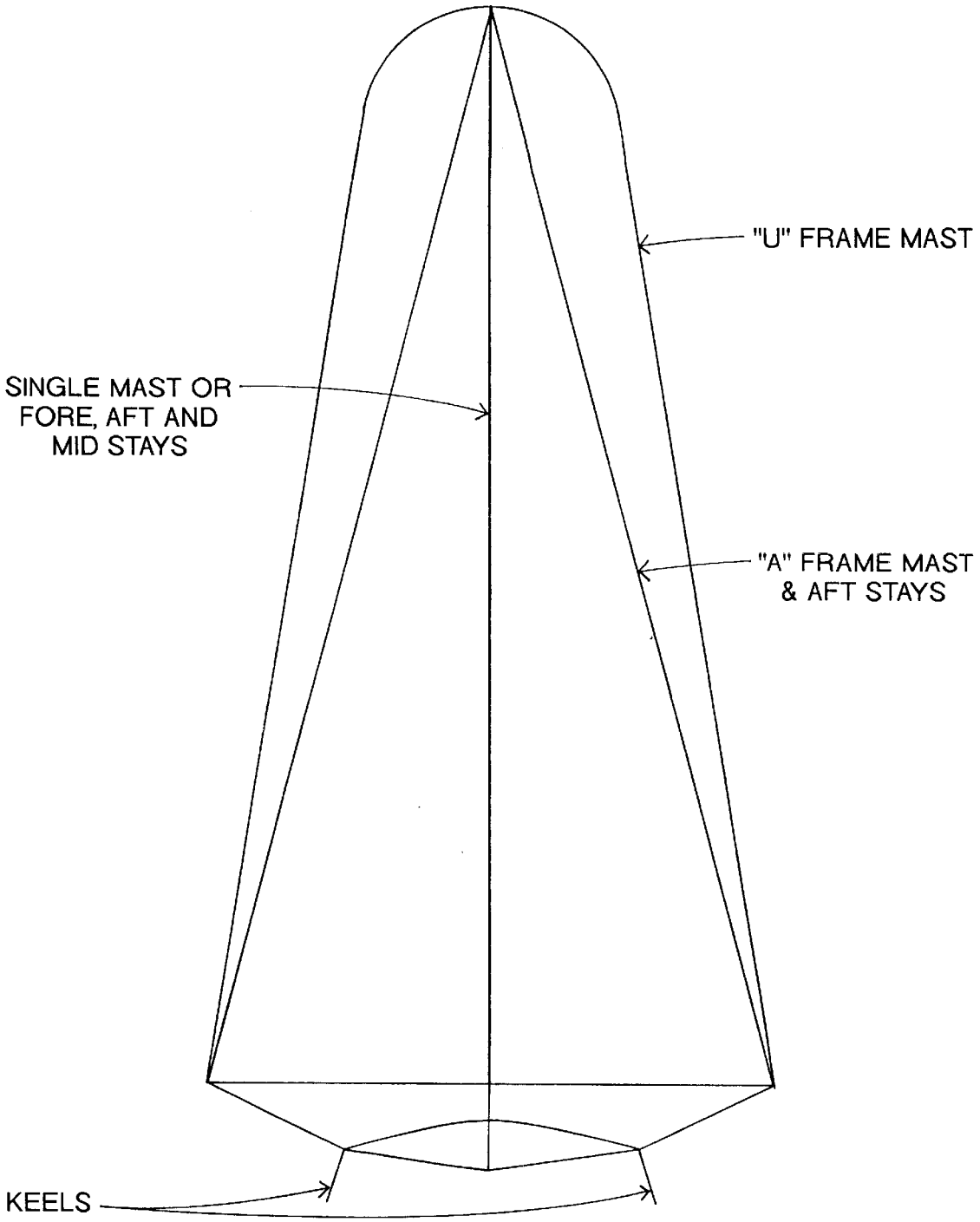

FIG. 3 is a front view of the sailboat with the mast and stays.

DETAILED DESCRIPTION OF THE INVENTION

FIG. 2—PAWLEY SAIL AND RIGGING DESIGN

In FIG. 2, the first thing you will notice is that the mast is stepped aft of amidship and raked aft over the Stern 20. It 10 is mounted on a wide planing hull 1.

You will notice that the mainsail is now mounted in the bow 21 of the boat 2 and attached to the Forestay 12, and the boom has been eliminated from the lower edge of the sails in order to prevent the second airfoil section from forming and creating a downward force.

A wishbone boom 15 has replaced the conventional booms in order to keep the sail as flat as possible and allowing only one airfoil section; as the back of the sail swings from port to starboard pivoting on the forestay. The aft sail swings port to starboard pivoting on the midstay.

The two wishbone booms 15 have traveling pulleys 30 with lines going to the deck 22 so that the sails can be flattened for close hauling.

You will notice that there is no downward force created; the forces are all up. It has a wide hull, and thin keels 5 to prevent side slip, no weight, and almost no drag. Unlimited speed!

A backstay 14 is shown in the drawing because it is necessary to keep the Forestay 12 extremely tight!

The rudder is not shown in the drawing because there is no major change in its design.

FIG. 3—PAWLEY SAIL AND RIGGING DESIGN

FIG. 3 is a front view of the boat showing the wide hull with two short thin keels 5. This drawing is really three drawings in one, because I use it to show all three masts that can be used. It is more efficient to use the "A Frame" 101 or the "U Frame" 102 mast because the aft sail is mounted on a wire midstay 16, which eliminates disturbance of the air flow over the sail, but, of course, a single mast can be used, if it is stepped in the right place and raked aft.

You will notice that the center vertical line represents the Forestay; the Midstay; the Aft Stay; and the single mast if one is used.

Of course, if the "U Frame" 102 mast were used, then the "A Frame" 101 drawing would be eliminated, and if the "A Frame" mast were used, then the "U Frame" drawing would be eliminated. If the single mast were used then the "A Frame" and the "U Frame" masts would not appear on the drawing.

The conventional Sail Boat Design is very old, and is Aerodynamically and Hydrodynamically incorrectly designed for speed.

It is simple enough to correct the Hydrodynamics by just changing the hull to a Planing Speedboat Hull; but the problem is that the Conventional Sail Design will not work on that Planing Hull, because of the downward force in the bow. The Planing Hull must carry the weight in the stern (like an Outboard Racing Boat. The driver sits in the stern and the Outboard Motor is actually behind the boat, and it has a light canvas deck forward. They attain great speeds with comparatively little power, because they are not moving water, they are skipping over it).

The real task then is to redesign the Aerodynamics of the Sails and/Rigging to eliminate the downward forces; and to create upward forces where possible; and to increase the efficiency of the sails; and to properly mount them on the hull.

Therefore this Patent application is for the Design of the Rigging or the Aerodynamic portion of the Sailing Craft. The downward forces created by the sails are eliminated by removing the booms from the lower edges of the sails; and making the sails flat with no belly; and making the sails loose-footed so that air can spill out the bottom edge as it does on the trailing edge. Then you replace the boom with Wishbone Booms to create the single Airfoil section. (There are a number of ways to make the sails flat-Wishbone Booms—Battens—stiff sail material like plastic or metal—and an actual metal or fabric airfoil section). To create the upward forces you move the mast aft to amid-ship and attach the mainsail 11 to the forestay, 12 and the aft sail to the midstay 16. You have now created two upward forces, one on each sail. You have also increased the efficiency of each sail by mounting them on stays which eliminate the disturbance of the airflow over the sails. Notice Drawing No. 2.

What is claimed is:

1. A sailboat comprising;

a planing hull, a mast, a foresail, a mainsail, at least one ballastless keel, a midstay, and a means for adjusting the camber of said sails, wherein said mast forms a rearward acute angle with a deck of said boat, wherein said foresail is loose-footed and the leech of said foresail is attached to said forestay, wherein said mainsail is loose-footed and the leach of the mainsail is attached to said midstay, and, wherein said backstay intersects said deck at an angle greater than said rearward acute angle.

2. The sailboat of claim 1, further comprising: at least one wishbone boom attached to said forestay or said midstay by a traveling pulley, said pulley capable of adjusting the camber of said foresail or mainsail by moving said boom up and down along said forestay or midstay.

3. The sail boat of claim 1, wherein said mast is an A frame mast comprising two vertical spars rising from sail hull, one of said vertical spars from the starboard side and other of said vertical spars from the port side, each of said vertical spars connected at an upper en to each other at a point over the center of said hull, wherein said vertical spars form an "A" shaped structure when viewed from the bow or the stem of said boat.

4. The sail boat of claim 1, wherein said mast is an U frame mast comprising two vertical spars rising from sail hull, one of said vertical spars from the starboard side and other of said vertical spars from the port side, each of said vertical spars connected at an upper en to each other at a point over the center of said hull, wherein said vertical spars form an inverted "U" shaped structure when viewed from the bow or the stem of said boat.

* * * * *